US011691780B2

(12) United States Patent
Sheldon

(10) Patent No.: US 11,691,780 B2
(45) Date of Patent: Jul. 4, 2023

(54) BLANK FOR FORMING A PACKAGING CONTAINER AND A PACKAGING CONTAINER

(71) Applicant: MARS, INCORPORATED, McLean, VA (US)

(72) Inventor: David Sheldon, Batley (GB)

(73) Assignee: MARS, INCORPORATED, McLean, VA (US)

( * ) Notice: Subject to any disclaimer, the term of this patent is extended or adjusted under 35 U.S.C. 154(b) by 0 days.

(21) Appl. No.: 17/275,624

(22) PCT Filed: Sep. 11, 2019

(86) PCT No.: PCT/EP2019/074247
§ 371 (c)(1),
(2) Date: Mar. 11, 2021

(87) PCT Pub. No.: WO2020/053287
PCT Pub. Date: Mar. 19, 2020

(65) Prior Publication Data

US 2022/0041326 A1 Feb. 10, 2022

(30) Foreign Application Priority Data

Sep. 11, 2018 (GB) ..... 1814740

(51) Int. Cl.
*B65D 5/60* (2006.01)

(52) U.S. Cl.
CPC ..... *B65D 5/606* (2013.01)

(58) Field of Classification Search
CPC ..... B65D 5/60–606
(Continued)

(56) References Cited

U.S. PATENT DOCUMENTS 1,907,067 A * 5/1933 Hartmann ..... B65D 5/703 493/110
2,142,342 A * 1/1939 Bensel ..... B65D 5/603 229/133

(Continued)

FOREIGN PATENT DOCUMENTS

FR 805165 A * 11/1936 ..... B65D 5/603
GB 178308 A 4/1922

(Continued)

OTHER PUBLICATIONS

International Search Report dated Dec. 6, 2019 in International Application No. PCT/EP2019/074247.

*Primary Examiner* — Nathan J Newhouse
*Assistant Examiner* — Phillip D Schmidt
(74) *Attorney, Agent, or Firm* — Baker Botts L.L.P.

(57) ABSTRACT

A blank for forming a packaging container, the blank comprising: a sheet defining an internal side and an external side of the packaging container; wherein the sheet comprises: a plurality of side panels separated from one another by side crease lines; a plurality of flaps, each one of the flaps extending from one of the side panels and being joined to the respective side panel by a flap crease line, each pair of adjacent flaps forming an inner flap and an outer flap; a sealant film disposed on the internal side of the sheet and having areas which are bonded to a portion of each one of the side panels and to a portion of each one of the flaps; wherein the sealant film comprises an unbonded area between the areas bonded to adjacent inner and outer flaps to allow the inner flap to first be folded inwards before the outer flap is folded onto the inner flap to form an end panel of the packaging container, with the sealant film forming a seal between the flaps.

18 Claims, 2 Drawing Sheets

Figure 1:
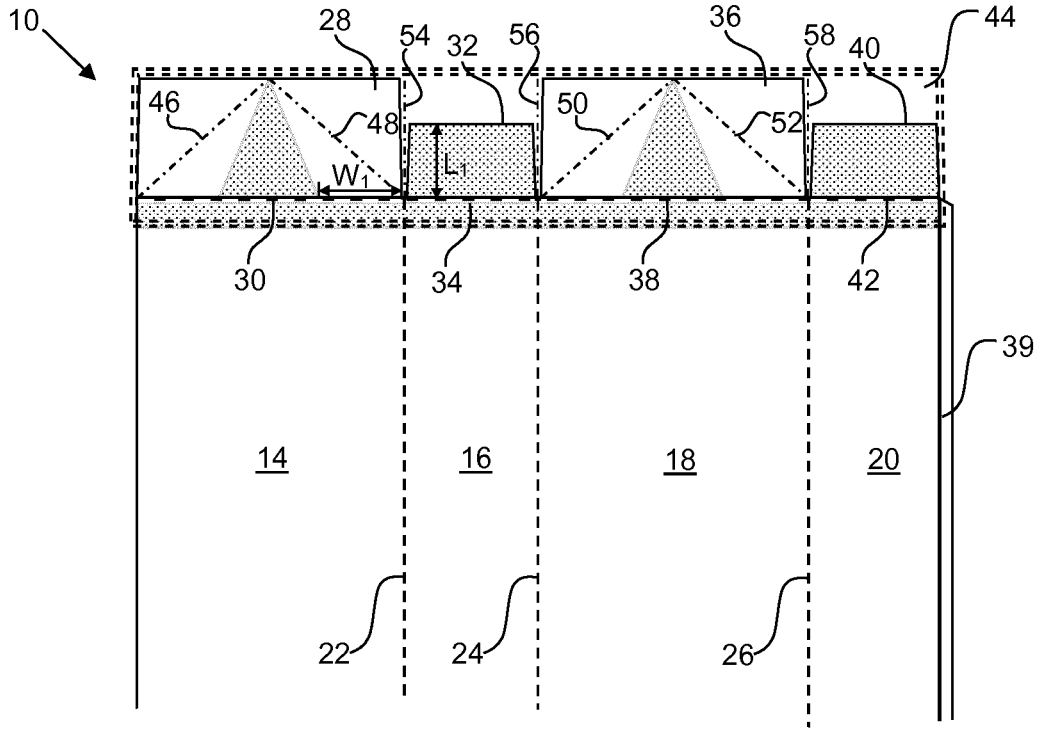

(58) Field of Classification Search
USPC ..... 229/117.24, 117.32, 164.2
See application file for complete search history.

(56) References Cited

U.S. PATENT DOCUMENTS

| | | | | | |
|---|---|---|---|---|---|
| 3,071,304 | A * | 1/1963 | Brastad | B65D 5/541 | 229/117.34 |
| 3,136,471 | A | 6/1964 | Brastad | | |
| 3,169,086 | A * | 2/1965 | Meissner | B65D 5/606 | 156/289 |
| 5,506,036 | A | 4/1996 | Bergerioux | | |
| 6,056,680 | A * | 5/2000 | Spronk-Dik | B65D 5/603 | 493/151 |

FOREIGN PATENT DOCUMENTS

| | | | | |
|---|---|---|---|---|
| GB | 904471 | A * | 8/1962 | B65D 5/606 |
| GB | 1 575 482 | A | 9/1980 | |
| GB | 1575482 | A * | 9/1980 | B65D 5/603 |
| WO | WO 97/32788 | A1 | 9/1997 | |

* cited by examiner

BLANK FOR FORMING A PACKAGING CONTAINER AND A PACKAGING CONTAINER

CROSS-REFERENCE TO RELATED APPLICATIONS

This application is a U.S. National Stage Patent Application under 35 U.S.C. § 371 of International Patent Application No. PCT/EP2019/074247, filed on Sep. 11, 2019, which claims the benefit of priority to United Kingdom Patent Application Serial No. 1814740.5, filed on Sep. 11, 2018, the contents of each of which are hereby incorporated by reference in their entireties, and to each of which priority is claimed.

The present disclosure relates to a blank for forming a packaging container and a packaging container.

Packaging containers are commonly used to hold goods, such as foodstuffs, during transport and storage in order to provide protection to the goods. However, packaging containers are not typically well sealed and so it is often necessary to provide an additional protective wrapper (e.g. a plastic bag) within the container to ensure that the goods cannot escape from the container and to prevent premature degradation of the goods.

The provision of an additional protective wrapper is a costly and inconvenient step during the packaging process.

The present disclosure thus seeks to address this issue by providing a packaging container which is, itself, sealed, such that goods do not require an additional protective wrapper.

In accordance with a first aspect, there is described a blank for forming a packaging container, the blank comprising: a sheet defining an internal side and an external side of the packaging container; wherein the sheet comprises: a plurality of side panels separated from one another by side crease lines; a plurality of flaps, each one of the flaps extending from one of the side panels and being joined to the respective side panel by a flap crease line, each pair of adjacent flaps forming an inner flap and an outer flap; a sealant film disposed on the internal side of the sheet and having areas which are bonded to a portion of each one of the side panels and to a portion of each one of the flaps; wherein the sealant film comprises an unbonded area between the areas bonded to adjacent inner and outer flaps to allow the inner flap to first be folded inwards before the outer flap is folded onto the inner flap to form an end panel of the packaging container, with the sealant film forming a seal between the flaps.

The unbonded area may extend across a portion of the outer flap.

The unbonded area may extend across the outer flap by a distance which is greater than or equal to a length of the inner flap from the flap crease line so that the outer flap can lie directly against the inner flap.

The sealant film may be bonded to a triangular area of the outer flap which has its base located along the flap crease line and its apex located towards a free edge of the outer flap.

The triangular area may be centred along the flap crease line of the outer flap.

The triangular area may be an isosceles triangle.

At least one crease line may be formed in the unbonded area of the sealant film.

The at least one crease line formed in the unbonded area of the sealant film may comprise a transverse crease line which extends across the sealant film and is formed in an opposite direction to the side crease lines.

The at least one crease line formed in the unbonded area of the sealant film may comprise a diagonal crease line which extends from a corner of the outer flap at the flap crease line to a centre of a free edge of the outer flap.

The sealant film may be bonded to the entire area of the inner flap.

The sealant film may be bonded to the internal side of the sheet over a portion of each one of the side panels to form a continuous strip.

The sheet may comprise in series a first side panel and a first flap joined to the first side panel, a second side panel and a second flap joined to the second side panel, a third side panel and a third flap joined to the third side panel, and a fourth side panel and a fourth flap joined to the fourth side panel; wherein the first and third flaps form outer flaps and the second and fourth flaps form inner flaps.

The sealant film may be a water-soluble synthetic polymer.

The sealant film may be polyvinyl alcohol.

In accordance with another aspect, there is provided a packaging container assembled from a blank as described above.

For a better understanding of the disclosure, and to show more clearly how aspects of the disclosure may be carried into effect, reference will now be made, by way of example, to the accompanying drawings, in which:—

Figure 2:
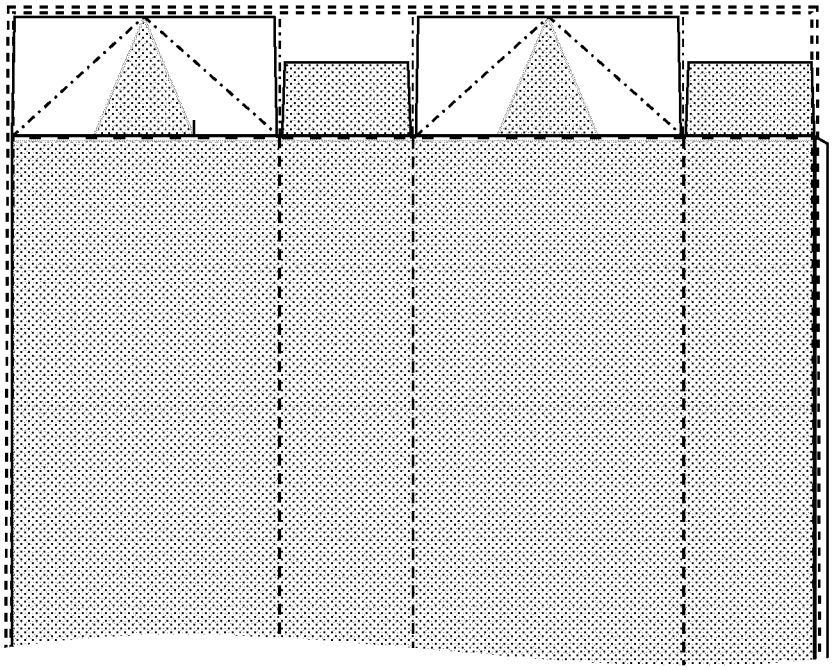

FIG. 1 schematically shows a plan view of a blank in accordance with a first example; and FIG. 2 schematically shows a plan view of a blank in accordance with a second example.

FIG. 1 shows a blank 10 suitable for assembly into a packaging container or carton, such as a regular slotted container. The blank 10 is formed from a sheet 12 of cardboard (e.g. corrugated fibreboard or paperboard) or the like which defines an internal side of the finished carton (as seen in a FIG. 1) and an external side of the finished carton (the opposing side, not visible in FIG. 1). The blank 10 comprises a first side panel 14, a second side panel 16, a third side panel 18 and a fourth side panel 20. The first side panel 14 is separated from the second side panel by a first side crease line 22. The second side panel 16 is separated from the third side panel 18 by a second side crease line 24. The third side panel 18 is separated from the fourth side panel 20 by a third side crease line 26.

A first flap 28 extends from an end of the first side panel 14. The first flap 26 is joined to the end of the first side panel 14 along a first flap crease line 30. A second flap 30 extends from an end of the second side panel 14. The second flap 32 is joined to the end of the second side panel 16 along a second flap crease line 34. A third flap 36 extends from an end of the third side panel 18. The third flap 36 is joined to the end of the third side panel 18 along a third flap crease line 38. A fourth flap 40 extends from an end of the fourth side panel 20. The fourth flap 40 is joined to the end of the fourth side panel 20 along a fourth flap crease line 42.

As shown, a sealant film 44 (shown using a double-dashed border for clarity) is provided along an upper portion of the blank 10. The sealant film 44 is rectangular in shape, and comprises areas which are glued or otherwise bonded to portions of the first, second, third and fourth side panels of the blank 10 and to portions of the first, second, third and fourth flaps, as depicted by the shaded area of FIG. 1. In particular, the sealant film 44 is bonded to the first, second, third and fourth side panels 14, 16, 18, 20 along a continuous strip extending a short distance (e.g. 15 mm) into the side panels and running along the flap crease lines 30, 34, 38, 42. Further, the sealant film 44 is bonded to a triangular area of each of the first and third flaps 28, 36, and to the entire area of the second and fourth flaps 32, 40. The triangular areas are the shape of isosceles triangles having their bases centred on the first and third flap crease lines 30, 38 and tapering to an apex located at the centre of the free edge of the first and third flaps 28, 36 (although in some examples, the apex may be spaced inwards of the free edge) distal from the first and third side panels 14, 18 respectively. The base of each triangular bonded area is shorter than the length of the respective flap crease line 30, 38 (or, in other words, the width of the first and third panels 14, 18). Consequently, an unbonded area of the sealant film 44 is formed between the areas bonded to adjacent flaps. The width $W_1$ of the unbonded area (measured parallel to the crease line 30, 38) is greater than or equal to the length $L_1$ of the second and fourth flaps 32, 40.

In the unbonded areas, the sealant film 44 is creased along diagonal crease lines 46, 48, 50, 52, as depicted in FIG. 1 by the dot-dash lines.

The diagonal crease lines 46, 48 extend from the apex of the triangular bonded area on the first flap 28 to the bottom corners of the first flap 28 at the first flap crease line 30. Similarly, the diagonal crease lines 50, 52 extend from the apex of the triangular bonded area on the third flap 36 to the bottom corners of the first flap 36 at the third flap crease line 38. As shown, the side crease lines 22, 24, 26 formed between the side panels 14, 16, 18, 20 extend into the sealant film 44 to form additional transverse crease lines 54, 56, 58 that extend across the sealant film (parallel to the side crease lines 22, 24, 26). However, the transverse crease lines are formed in the opposite direction (i.e. on the opposite side) to the side crease lines. The transverse crease lines 54, 56, 58 intersect the diagonal crease lines at the flap crease lines.

To assemble the blank 10 into a carton, the first and fourth side panels 14, 20 are first affixed along their free edges by gluing, taping, stapling or any other method. In the example shown in FIG. 1, a tab 39 is provided along the edge of the fourth side panel 20 which can be glued to the free edge of the first side panel 14. A further side crease line may be formed between the first and fourth side panels 14, 20, for example, via the tab 39. As part of this process or in a separate process, free ends of the sealant film 44 are joined to one another to form a continuous loop of sealant film 44 on the interior surface of the part-formed carton. A further transverse crease line may be formed between the ends of the sealant film 44 which extends parallel to the crease line between the first and fourth side panels 14, 20.

The first and third side panels 14, 18 form a first pair of opposing sides of the carton and the second and fourth side panels 16, 20 form a second pair of opposing sides of the carton. The flaps 28, 32, 36, 40 are folded over to form an end panel of the carton. The second and fourth flaps 32, 40 are folded inwards prior to the first and third flaps 28, 36 such that the second and fourth flaps 32, 40 form a pair of minor (or inner) flaps, whereas the first and third flaps 28, 36 form a pair of major (or outer) flaps, with the minor flaps sitting internally of the major flaps. As the second and fourth flaps 32, 40 are folded inwards, the unbonded area of the sealant film 44 also folds inwards about the diagonal crease lines 46, 48, 50, 52 and away from the first and third flaps 28, 36. The inward movement of the second and fourth flaps 32, 40 also draws the first and third flaps 28, 36 inward via the sealant film 44.

As described previously, the width $W_1$ of the unbonded area of sealant film 44 is greater than or equal to the length $L_1$ of the second and fourth flaps 32, 40 such that the second and fourth flaps lie directly against the inner side of the first and third flaps 28, 36 (i.e. between the first and third flaps 28, 36 and the unbonded area of sealant film 44) when the flaps are closed (i.e. when folded inwards such that they are perpendicular to the side panels). Accordingly, this process creates a 'board-to-board' contact between the exterior surfaces of the second and fourth flaps 32, 40 and the interior, unbonded areas of the first and third flaps 28, 36, with the sealant film 44 folded into the interior of the carton.

The diagonal and/or transverse crease lines formed in the sealant film 44 are configured such that they encourage the sealant film 44 to fold inwards into the interior of the carton, as opposed to outwardly towards the exterior of the carton. In particular, as described previously, the transverse crease lines are formed in the opposite direction to the side crease lines.

It will be appreciated that, although not shown, a similar arrangement of flaps and sealant film is provided at the opposite ends of the side panels so as to form the other end panel of the carton, but this will not be described in detail.

A single sheet of sealant film 44 may seal both ends of the carton. In particular, as shown in FIG. 2, the sealant film 44 may extend across the entire side panels and over both sets of flaps. Alternatively, a strip of sealant film 44 could be used to seal each end of the carton, with the sheet 12 of cardboard between the ends of the carton being coated (for example with Polyvinyl Alcohol (PVA/PVOH)).

The sealant film 44 creates an additional seal (which may be a hermetic seal) within the closure formed by the flaps. In particular, the sealant film 44 provides a seal between the flaps. This removes the need for perishable goods to be stored in a separate wrapper in the carton, as the carton essentially forms both the carton and wrapper in a single component.

The sealant film 44 may be formed from a water-soluble synthetic polymer, such as Polyvinyl Alcohol (PVA/PVOH). This may allow the carton to be recycled using standard techniques and without needing to first remove the sealant film 44. Both low and high temperature PVAs could be used, with high temperature in this context meaning that the PVA only dissolves when in contact with water at a temperature over 65° C. Alternative materials for the sealant film include polyethylene (PE), polypropylene (PP), polyethylene terephthalate (PET), polyactic acid (PLA), polyhydroxyalkanoate (PHA), polyvinyl chloride (PVC), polystyrene (PS) or any suitable polyolefin or polymer.

The invention is not limited to the specific embodiments disclosed above, and obvious modifications and substitutions will be apparent to those skilled in the art.

For example, while the embodiment shown in FIG. 1 is a blank suitable for assembly into a cuboidal carton, any polyhedral shape could be made in practice using the same principle. Further, although the sealant film has been described as being rectangular, it may have other forms. For example, the sealant film may shaped to follow the outline of the flaps of the blank. Although the bonded areas on the first and third flaps 28, 36 have been described as being the shape of isosceles triangles, they may also be equilateral triangles, depending on the relative proportions of the flaps. In fact, the bonded areas need not be triangular and could have other configurations, such as rectangular. The sealant film also need not be bonded to the entire area of the second and fourth flaps 32, 40. The selective bonding of the sealant film to the flaps is intended to allow the film to fold into the interior of the carton as the flaps are folded inwards and it will be appreciated that this could be achieved in various ways. The film may also be arranged such that a fold is preformed into the sealant film between adjacent flaps so as to provide excess film that allows the flaps to fold closed. In other words, the length of the unbonded area of sealant film between adjacent flaps is greater than the distance between the adjacent flaps such that the excess material gathers into a fold.

The invention claimed is:

1. A blank for forming a packaging container, the blank comprising:

a sheet defining an internal side and an external side of the packaging container;

wherein the sheet comprises:

a plurality of side panels separated from one another by side crease lines;

a plurality of flaps, each one of the flaps extending from one of the side panels and being joined to the respective side panel by a flap crease line, each pair of adjacent flaps defining an inner flap and an outer flap;

a sealant film disposed on the internal side of the sheet and having areas which are bonded to a portion of each one of the side panels and to a portion of each one of the flaps;

wherein the sealant film comprises an unbonded area between the areas bonded to adjacent inner and outer flaps to allow the inner flap to first be folded inwards before the outer flap is folded onto the inner flap to form an end panel of the packaging container, with the sealant film forming a seal between the flaps, wherein the unbonded area extends across a portion of the outer flap and the sealant film remains unbonded with respect to the outer flap along a diagonal crease line of the sealant film;

wherein the sealant film is bonded to a triangular area of the outer flap which has its base located along the flap crease line, wherein the base of the bonded triangular area is shorter than a length of the flap crease line; and wherein the sealant film is a water-soluble synthetic polymer.

2. A blank as claimed in claim 1, wherein the unbonded area extends across the outer flap by a distance which is greater than or equal to a length of the inner flap from the flap crease line so that the outer flap can lie directly against the inner flap.

3. A blank as claimed in claim 1, wherein an apex of the triangular area is located towards a free edge of the outer flap.

4. A blank as claimed in claim 1, wherein the triangular area is centered along the flap crease line of the outer flap.

5. A blank as claimed in claim 1, wherein the triangular area is an isosceles triangle.

6. A blank as claimed in claim 1, further comprising a transverse crease line formed in the unbonded area of the sealant film which extends across the sealant film and is formed in an opposite direction to the side crease lines.

7. A blank as claimed in claim 1, wherein the diagonal crease line extends from a corner of the outer flap at the flap crease line to a center of a free edge of the outer flap.

8. A blank as claimed in claim 1, wherein the sealant film is bonded to the entire area of the inner flap.

9. A blank as claimed in claim 1, wherein the sealant film is bonded to the internal side of the sheet over a portion of each one of the side panels to form a continuous strip.

10. A blank as claimed in claim 1, wherein the sheet comprises in series a first side panel and a first flap joined to the first side panel, a second side panel and a second flap joined to the second side panel, a third side panel and a third flap joined to the third side panel, and a fourth side panel and a fourth flap joined to the fourth side panel; wherein the first and third flaps form outer flaps and the second and fourth flaps form inner flaps.

11. A blank according to claim 1, wherein the sealant film is polyvinyl alcohol.

12. A packaging container assembled from a blank according to claim 1.

13. A blank according to claim 1, wherein inward folding of the inner flap draws the outer flap inward via the sealant film.

14. A blank for forming a packaging container, the blank comprising:

a sheet defining an internal side and an external side of the packaging container;

wherein the sheet comprises:

a plurality of side panels separated from one another by side crease lines;

a plurality of flaps, each one of the flaps extending from one of the side panels and being joined to the respective side panel by a flap crease line, each pair of adjacent flaps defining an inner flap and an outer flap;

a sealant film disposed on the internal side of the sheet and having areas which are bonded to a portion of each one of the side panels and to a portion of each one of the flaps;

wherein the sealant film comprises an unbonded area between the areas bonded to adjacent inner and outer flaps to allow the inner flap to first be folded inwards before the outer flap is folded onto the inner flap to form an end panel of the packaging container, with the sealant film forming a seal between the flaps, wherein the unbonded area extends across a portion of the outer flap, the inward folding movement of the inner flap draws the outer flap inward to form the packaging container, and the unbonded area extends across the outer flap by a distance which is greater than or equal to a length of the inner flap from the flap crease line so that the outer flap can lie directly against the inner flap;

wherein the sealant film is bonded to a triangular area of the outer flap which has its base located along the flap crease line, wherein the base of the bonded triangular area is shorter than a length of the flap crease line; and wherein the sealant film is a water-soluble synthetic polymer.

15. A blank as claimed in claim 14, wherein an apex of the triangular area is located towards a free edge of the outer flap.

16. A blank as claimed in claim 14, wherein the triangular area is centered along the flap crease line of the outer flap.

17. A blank as claimed in claim 14, wherein the triangular area is an isosceles triangle.

18. A packaging container assembled from a blank according to claim 14.

* * * * *